United States Patent [19]

Nakajima

[11] 4,257,711

[45] Mar. 24, 1981

[54] PROPORTIONAL SPACING IMPACT PRINTING APPARATUS

[75] Inventor: Yoshinori Nakajima, Tokyo, Japan

[73] Assignee: Ricoh Company, Ltd., Tokyo, Japan

[21] Appl. No.: 12,902

[22] Filed: Feb. 16, 1979

[30] Foreign Application Priority Data

Feb. 20, 1978 [JP] Japan ..... 53-18207

[51] Int. Cl.[3] ..... B41J 19/32

[52] U.S. Cl. ..... 400/306; 400/111; 364/523

[58] Field of Search ..... 400/303-306, 400/306.1-306.4, 9-11, 3-7, 109-111; 364/200, 900, 519, 523

[56] References Cited

U.S. PATENT DOCUMENTS

| | | | |
|---|---|---|---|
| 2,806,575 | 9/1957 | Higonnet | 400/306 |
| 3,354,816 | 11/1967 | Giannuzzi | 400/306 |
| 3,513,968 | 5/1970 | Hanson | 400/9 |
| 3,712,443 | 1/1973 | Mathews | 400/303 |
| 3,998,310 | 12/1976 | Chandhry | 400/111 |

FOREIGN PATENT DOCUMENTS

| | | | |
|---|---|---|---|
| 2612815 | 9/1977 | Fed. Rep. of Germany | 400/304 |

OTHER PUBLICATIONS

Hurley et al., "Positioning of . . . Characters", IBM Technical Disclosure Bulletin, vol. 22, No. 6, pp. 2183-2184, 11/79.

Tanner, "Printer . . . Space Control", IBM Technical Disclosure Bulletin, vol. 12, No. 12, pp. 2260-2261, 5/70.

*Primary Examiner*—William Pieprz

*Attorney, Agent, or Firm*—David G. Alexander

[57] ABSTRACT

A printing element (90) which is rotatable to different positions to print characters having different widths is carried by a carriage (98). The width of each character is divided into a leading width portion and a trailing width portion which are oriented leftwardly and rightwardly respectively of a centerline of the character. For printing a present or next character, the trailing width portion of a previous character is added to the leading width portion of the present character and the carriage (98) is shifted by a shift width which is equal thereto. The character is printed following the shift operation. For printing a character at the beginning of a line or following a blank space, the carriage (98) is shifted only by the leading width portion of the present character prior to printing.

6 Claims, 7 Drawing Figures

PROPORTIONAL SPACING IMPACT PRINTING APPARATUS

BACKGROUND OF THE INVENTION

The present invention relates to a proportional spacing impact printing apparatus using a printing element in the form of a daisy wheel, cylinder or the like for printing a plurality of characters having different widths.

Impact printers known in the art use either equal spacing or proportional spacing arrangements. In the equal spacing system each character occupies the same space or width in a printed line. In the proportional spacing system the characters have different widths. Proportional spacing is especially desirable for script alphabets of the like which are designed to simulate handwriting. In such an alphabet a letter such as "m" has a large width while a letter such as "1" has a small width.

SUMMARY OF THE INVENTION

A proportional spacing printing apparatus embodying the present invention includes a carriage, printing element means carried by the carriage for printing a plurality of characters of different widths and carriage drive means for shifting the carriage. Memory means store a width parameter of a previous selected character. Detector means detect a width parameter of a present selected character. Computing means compute a shift width as a predetermined function of the width parameters of the previous and present selected characters, and control means control the carriage drive means to shift the carriage by the shift width and subsequently control the printing element means to print the present selected character.

It is an object of the present invention to provide a proportional spacing impact printing apparatus which is capable of printing characters of different widths in such a manner that the actual character spaces exactly abut with each other.

It is another object of the present invention to provide a proportional spacing printing apparatus which prints characters of different widths in a manner which is much more legible than comparable apparatus known heretofore.

It is another object of the present invention to provide a proportional spacing printing apparatus which is capable of printing characters of different widths in an accurate and aethestic manner using a standard printing element.

It is another object of the present invention to provide a generally improved proportional spacing impact printing apparatus.

Other objects, together with the foregoing, are attained in the embodiment described in the following description and illustrated in the accompanying drawing.

DESCRIPTION OF THE PREFERRED EMBODIMENT

While the proportional spacing impact printing apparatus of the present invention is susceptible of numerous physical embodiments, depending upon the environment and requirements of use, substantial numbers of the herein shown and described embodiment have been made, tested and used, and all have performed in an eminently satisfactory manner.

Figure 1:
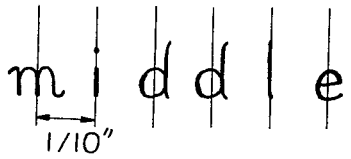
Fig. 1 PRIOR ART
FIG. 1 is a diagram illustrating a prior art printing system.

FIG. 1 of the drawing illustrates a well known prior art printing system in which each character is printed at an equal space from the previous character. The centerlines of the characters, which are illustrated as vertical solid lines but not designated by reference numerals, are equally spaced from each other at distances 1/10" (0.25 mm). Such a system is not desirable for script type alphabets due to the different widths of the characters. In the example of FIG. 1 which illustrates the word "middle", there are excessive spaces between the "i" and the "m" and also between the "i" and the first "d" due to the small width of the "i". There are also excessive spaces between the second "d" and the "1" and between the "1" and the "e" due to the small width of the "1". Such a system produces unaesthetic printing.

Figure 2:
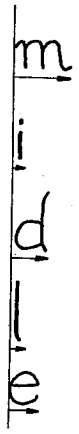
Fig. 2 PRIOR ART
FIG. 2 is a diagram illustrating another prior art printing system.
Figure 3:
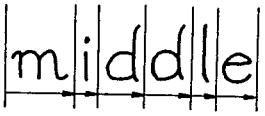
Fig. 3 PRIOR ART
FIG. 3 is a diagram illustrating a word printed with the prior art printing system of FIG. 2.
Figure 5:
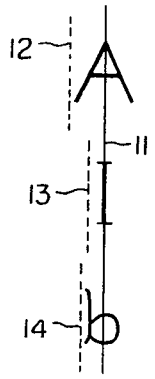
Fig. 5 PRIOR ART
FIG. 5 is a diagram illustrating a left edge of three printed lines which were printed using the prior art printing system of FIG. 2.

A prior art proportional spacing system is illustrated in FIGS. 2, 3 and 5. In FIG. 2, the widths of the various characters are indicated by arrows (not designated) under the characters. It will be noted that the width of the "m" is much larger than that of the "i" or "1".

This prior art system functions by initially positioning a printing element (not shown) so that the centerline of the first character coincides with a line 11 shown in FIG. 5. After printing the first character, the printing element is shifted rightwardly by a distance equal to the width of the second character. Then, the second character is printed and the printing element shifted by a distance equal to the width of the third character. Such a system produces a printing which is illustrated in FIG. 3. The prior art printer is, however, very intricate and expensive.

FIG. 5 illustrates another drawback of this prior art system in that the left standard edges of the characters "A", "I" and "b", designated as 12, 13 and 14 respectively, are not aligned with each other. This gives a ragged and unaesthetic appearance to the left edge of the three lines of printing.

Figure 4:
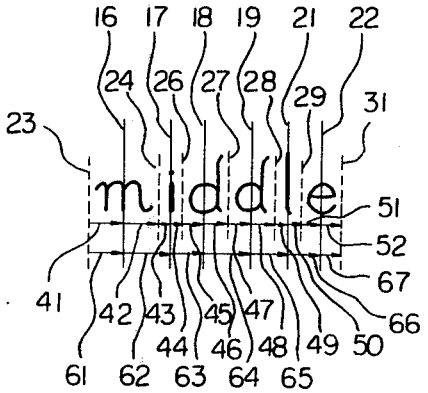
FIG. 4 is a diagram illustrating a proportional printing system embodying the present invention.
Figure 6:
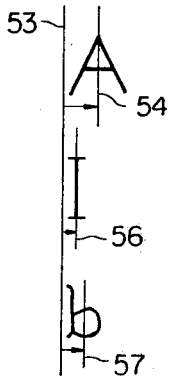
FIG. 6 is a diagram illustrating the left edge of the same three printed lines which were printed using the proportional spacing printing system of the present invention.

These drawbacks are overcome in accordance with the present invention as illustrated in FIGS. 4 and 6. The present system functions to divide each character width into two portions; a leading or left width portion and a trailing or right width portion which are located on opposite sides of a centerline of the character. Prior to printing of a present or next selected character, the leading width portion of the present character is added to the trailing width portion of a previously selected and printed character and the printing element is shifted by this distance. The present system ensures exact alignment of the left standard edge of a present character with the right standard edge of the previous character.

FIG. 4 illustrates the word "middle" printed in accordance with the present invention. The printed word is aesthetic in appearance because there are no excessive or insufficient spaces between characters.

The centerlines of the characters "m", "i", "d", "d", "1" and "e" are represented by vertical solid lines 16, 17, 18, 19, 21 and 22 respectively. The left standard edge of the character "m" is indicated by a vertical broken line 23. The right standard edge of the character "m" is coincident with the left standard edge of the character "i" and is designated as 24. The right standard edge of the character "i" is coincident with the left standard edge of the first character "d" and is designated as 26. The right standard edge of the first character "d" is coincident with the left standard edge of the second character "d" and is designated as 27. The right standard edge of the second character "d" is coincident with the left standard edge of the character "1" and is designated as 28. The right standard edge of the character "1" is coincident with the left standard edge of the character "e" and is designated as 29. The right standard edge of the character "e" is designated as 31.

The leading and trailing width portions of the character "m" are designated as 41 and 42 respectively. The leading and trailing width portions of the character "i" are designated as 43 and 44 respectively. The leading and trailing edge portions of the first character "d" are designated as 45 and 46 respectively. The leading and trailing edge portions of the second character "d" are designated as 47 and 48 respectively. The leading and trailing width portions of the character "1" are designated as 49 and 50 respectively. The leading and trailing edge portions of the character "e" are designated as 51 and 52 respectively.

The word "middle" is printed as follows in accordance with the method of the present invention. First, the printing element is shifted rightwardly by a shift width 61 which is equal to the leading width portion 41 of the character "m". Then, the character "m" is printed. Prior to the shift operation, the centerline 16 of the character "m" was coincident with the illustrated position of the left standard edge 23 in the manner illustrated in FIG. 5. It will be noted that the left standard edge position 23 as illustrated in FIG. 4 corresponds to the position of the line 11 in FIG. 5. However, the initial shifting operation of the present invention produces results as illustrated in FIG. 6 in which the left standard edges of the characters "A", "I" and "b" are all coincident with a line 53 which corresponds to the line 11 and centerlines 54, 56 and 57 of the characters "A", "I" and "b" are oriented rightwardly of the line 53. Thus, the left edges of the characters in FIG. 6 are aligned with each other and aesthetically appealing.

To continue with the printing of the word "middle" as illustrated in FIG. 4, the next character to be printed is "i". In this case the trailing width portion 42 of the character "m" is added to the leading width portion 43 of the character "i" and the printing element is shifted rightwardly by a shift width 62 which is equal to the sum of the widths 42 and 43. Then, the character "i" is printed. It will be understood that as the result of this shifting operation the right standard edge of the character "m" is exactly aligned with the left standard edge of the character "i" as indicated at 24, eliminating the excessive space in the prior art system of FIG. 1.

After printing the character "i", the printing element is shifted by a shift width 63 which is equal to the sum of the trailing width portion 44 of the character "i" and the leading width portion 45 of the first character "d". Then, the first character "d" is printed.

Subsequently, the printing element is moved by a shift width 64 which is equal to the sum of the trailing width portion 46 of the first character "d" and the leading width portion 47 of the second character "d". The second character "d" is printed after this shift movement.

Then, the printing element is moved by a shift width 65 which is equal to the sum of the trailing width portion 48 of the second character "d" and the leading width portion 49 of the character "1". Then, the character "1" is printed.

Then, the printing element is moved by a shift distance 66 which is equal to the sum of the trailing width portion 50 of the character "1" and the leading width portion 51 of the character "e" and the character "e" is printed.

Since the character "e" is the last character in the word "middle" it is required to produce a blank space between the "e" and the first character of the next word. In other words, the next selected character for printing is replaced by a blank space. This is accomplished in accordance with the present invention by shifting, after printing the character "e", the printing element by a shift distance 67 equal to the trailing width portion 52 of the character "e" and additionally by a distance equal to the width of a blank space. Following the blank space, the next selected character will be printed after shifting the printing element by a shift distance equal to the leading edge portion of the next or present selected character. It will thus be seen that the operation of printing the first character following a blank space is the same as printing the first character in a line.

Although not illustrated, a backspace operation may be performed by reversing the forward spacing operation. Alternatively, the backspace operation may be performed by shifting the printing element leftwardly by a distance equal to the leading width portion of the last character printed.

It will be noted that the leading and trailing width portions of the characters may or may not be equal to each other. The latter case is especially desirable for alphabets such as Japanese katakana in which additional marks may be added to basic characters to indicate pronounciation changes.

Figure 7:
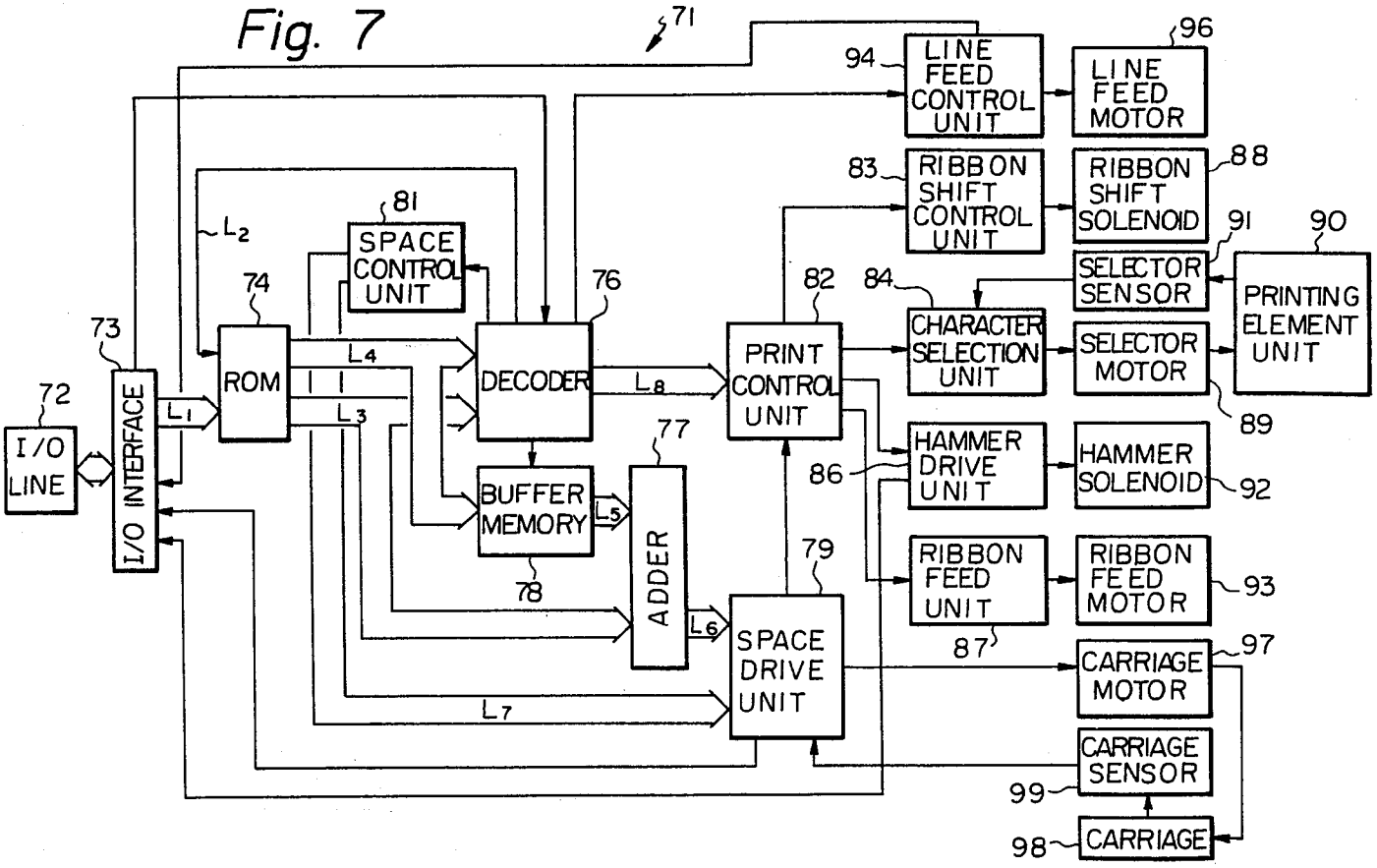
FIG. 7 is a block diagram of a proportional printing apparatus embodying the present invention.

Referring now to FIG. 7, a proportional spacing impact printing apparatus embodying the present invention is generally designated by the reference numeral 71 and comprises an input-output line 72 which is connected to an input keyboard, computer or other device for inputting character data (not shown). The character data is typically in the binary ASCII code format and is fed through the line 72 to an input-output interface 73. The character codes are fed through the interface 73 through a line L1 to a read-only memory (ROM) 74 as addresses. The interface 73 is also connected to a decoder 76.

The ASCII codes are fed to the ROM 74 as address inputs. Another address input consisting of one bit is applied to the ROM 74 from the decoder 76 through a line L2. When the line L2 is logically low, the addressed memory location in the ROM 74 will contain a binary number corresponding to the leading and trailing width portions of the selected character. The leading and trailing width portions appear as outputs on lines L3 and L4 respectively which are connected to inputs of the decoder 76. The lines L3 and L4 are also connected to inputs of an adder 77 and a buffer memory 78 respectively. The output of the buffer memory 78 is connected to another input of the adder 77 through a line L5.

The output of the adder 77 is connected to an input of a space drive unit 79 through a line L6. An output of the decoder 76 is connected to an input of a space control unit 81, the output of which is connected through a line L7 to another input of the space drive unit 79.

An output of the decoder 76 is connected through a line L8 to an input of a print control unit 82. Outputs of the print control unit 82 are connected to inputs of a ribbon shift control unit 83, a character selection unit 84, a hammer drive unit 86 and a ribbon feed unit 87. The output of the ribbon shift control unit 83 is connected to a ribbon shift solenoid 88 which is suitably designed to move a printing ribbon (not shown) up and down for setting one of colors to be printed.

The output of the character selection unit 84 is connected to an input of a selector motor 89 which is connected to position a printing element (not shown) of a printing element unit 90. As will be described in detail below, a selector sensor 91 senses the position of the printing element and feeds a signal corresponding thereto to the character selection unit 84. The hammer drive unit 86 has an output connected to a hammer solenoid 92 which is adapted to drive a printing hammer (not shown) for printing as will be described in detail below. Another output of the hammer drive unit 86 is connected to the interface 73 and indicates when the hammer is in motion.

The output of the ribbon feed unit 87 is connected to a ribbon feed motor 93 which feeds the ribbon by one increment each time a character is printed.

An output of the decoder 76 is connected to an input of a line feed control unit 94, an output of which is connected to a line feed motor 96. The line feed motor 96 is constructed to rotate a platen (not shown) by one increment for line feeding in response to a carriage return code or the like. Another output of the line feed control unit 94 is connected to the interface 73 and indicates when the line feed motor 96 is in operation.

An output of the space drive unit 79 is connected to a carriage motor 97 which is connected to shift a carriage 98. A carriage sensor 99 feeds a signal indicating the position of the carriage 98 to the space drive unit 79. The space drive unit 79 feeds a signal to the interface 73 indicating when the carriage 98 is in motion.

A sheet of paper is wound around a platen (not shown) for printing. The line feed motor 96 rotates the platen in an incremental manner for line feed. The carriage 98 is axially movable parallel to the axis of the platen by the motor 97 and carries the printing element unit 90 which comprises a printing element. The printing element, although not shown, is typically in the form of a daisy wheel or cylinder carrying character types having different widths. Assuming for example that the printing element is in the form of a daisy wheel, it will be understood that the daisy wheel is mounted on a shaft which may be rotated and shifted perpendicular to its axis to position a particular character type in a printing position under control of the character selection unit 84.

The printing element unit 90 is mounted on the carriage 98 which is shifted parallel to the axis of the platen by the carriage motor 97 under control of the space drive unit 79. This particular operation constitutes the subject matter of the present invention.

To print a first character of a line, a control means comprising the decoder 76 sets the contents of the buffer memory 78 to zero. It will be understood from further description that the buffer memory 78 stores the trailing width portion of a previous selected and printed character. Since in the case of the first character of a line there was no previous character, the trailing width portion is equal to zero.

The ASCII code representing the present or next selected character to be printed, in this case the first character of the line, is applied to the ROM 74 through the interface 73. At this time the decoder 76 produces a logically low output on the line L2 so that the memory location of the ROM 74 which is addressed contains the leading and trailing width portions of the present selected character. The leading width portion of the present selected character is applied to the adder 77. A zero width signal is applied to the other input of the adder 77 from the buffer memory 78 through the line L5. The decoder 76 feeds a signal to the space control unit 81 which in turn controls the space drive unit 79 and motor 97 to shift the carriage 98 and thereby the printing element rightwardly from an initial leftmost position by a distance equal to the shift width which appears at the output of the adder 77. In this case the shift width is equal to the leading width portion of the present selected character.

After the carriage 98 and printing element are shifted, the decoder 76 controls the buffer memory 78 to store the trailing width portion of the present selected character which appears on the line L4. Then, the decoder 76 applies a logically high signal on the line L2 which causes the address in the ROM 74 containing a selection code corresponding to the selected character to be accessed. This selection code is applied through the lines L3 and L4 to the decoder 76. Typically, the line L3 is four wire bus for the four lower order bits of an eight bit output of the ROM 74. The higher order four bits appear on the line L4 which is also a four wire bus.

The decoder 76 applies a signal to the print control unit 82 through the line L8 which indicates the position of the character type on the printing element which corresponds to the present selected character to be printed. The print control unit 82 controls the character selection unit 84 to energize the motor 89 to position the printing element at the proper position. Then, the print control unit 82 controls the hammer drive unit 86 to feed a signal to the hammer solenoid 92 causing the hammer to strike the selected spoke of the daisy wheel printing element and move the same into printing impact with the paper through the ribbon, thus printing the selected character. Then, the print control unit 82 controls the ribbon feed unit 87 to energize the ribbon feed motor 93 and move the ribbon by one increment.

In accordance with the selected character, the print control unit 82 controls the ribbon shift control unit 83 to move the ribbon up or down to the proper position.

For printing the next character, the operation is the same as for the first character except that the trailing width portion of the previous character is stored in the buffer memory 78. Thus, the output of the adder 77 which constitutes the shift width is the sum of the trailing width portion of the previous character and the leading width portion of the present character.

Where a blank space rather than a character is to be printed, the ROM 74 produces a zero output which is applied to the adder 77. Thus, the carriage 98 is shifted by a distance equal to the shift width which in this case is equal to the trailing width portion of the previous character. In addition, the space control unit 81 applies a signal to the space drive unit 79 causing the carriage 98 to be shifted by an additional distance equal to the width of a blank space. After the shifting operation is completed, the decoder 76 sets the contents of the buffer memory 78 to zero. Thus, for the next character following the blank space, the carriage 98 will be shifted by a distance equal to the leading width portion of the next character since the contents of the buffer memory 78 and zero.

Typically, the sensor 99 is constructed to produce a signal each time the carriage 98 is moved by an incremental distance, with each character width being an integral number of increments. In response to the output of the adder 77 which indicates the shift width, the space drive unit 79 presents an internal counter to the number of increments in the shift width and energizes the motor 97. For each incremental distance the carriage 98 moves the sensor 99 will produce a signal which will decrement the counter. When the carriage 98 has been shifted by the required number of increments the counter will be decremented to zero and the space drive unit 79 will de-energize the motor 97.

In a similar manner, the selector sensor 91 produces a signal each time the printing element is moved by an incremental distance which may be the distance between adjacent character types. The character selection unit 84 comprises an internal counter which is incremented or decremented by the signals from the sensor 91 in such a manner that the count of the counter indicates the position of the printing element.

In response to the signal from the print control unit 82, the character selection unit 84 energizes the selector motor 89 to rotate the printing element until the count in the counter of the character selection unit 84 is equal to the binary value of the signal applied from the print control unit 82. The signal from the print control unit 82 coresponds to a count in the counter of the character selection unit 84 at which the printing element is in the proper position for printing the present selected character. The character selection unit 84 de-energizes the selector motor 89 when the printing element reaches the proper position.

In summary, it will be seen that the present invention provides greatly improved proportional printing since character spacing is performed using the edges of character areas as references rather than centerlines as in the case with the prior art. Various modifications will become possible for those skilled in the art after receiving the teachings of the present disclosure without departing from the scope thereof. For example, if the leading and trailing width portions of the characters are made equal, the circuitry of FIG. 7 may be substantially simplified since it will become necessary to store only one width parameter for each character which is equal to either the leading or trailing width portion thereof.

What is claimed is:

1. A proportional spacing printing apparatus including a carriage, printing element means carried by the carriage for printing a plurality of characters of different widths and carriage drive means for shifting the carriage, characterized by comprising:

memory means for storing a width parameter of a previous selected character;

detector means for detecting a width parameter of a present selected character;

computing means for computing a shift width as a predetermined function of the width parameters of the previous and present selected characters; and control means for controlling the carriage drive means to shift the carriage by the shift width and subsequently control the printing element means to print the present selected character;

the width parameter of the previous selected character being a trailing width portion of the previous selected character and the width parameter of the present selected character being a leading width portion of the present selected character, the computing means comprising adder means for adding outputs of the memory means and detector means to produce the shift width.

2. An apparatus as in claim 1, in which the detector means is further adapted to detect the leading with portion of the present selected character and store the same in the memory means after controlling the carriage drive means to shift the carriage by the shift width.

3. An apparatus as in claim 1, in which the detector means is further adapted to detect when the present selected character is replaced by a blank space and produce a zero output in response thereto.

4. An apparatus as in claim 3, in which the control means is further adapted to detect when the present selected character is replaced by a blank space and control the carriage drive means to shift the carriage by a space width in addition to the shift width in response thereto.

5. An apparatus as in claim 4, in which the detector means is further adapted to set the memory means to zero after controlling the carriage drive means to shift the carriage by the space width and shift width when the present selected character is replaced by a blank space.

6. An apparatus as in claim 1, in which the carriage drive means is constructed to shift the carriage away from an initial position for printing characters, the control means being adapted to set the memory means to zero when the carriage is in the initial position.

* * * * *